US006564182B1

(12) United States Patent
Gao

(10) Patent No.: US 6,564,182 B1
(45) Date of Patent: May 13, 2003

(54) LOOK-AHEAD PITCH DETERMINATION

(75) Inventor: Yang Gao, Mission Viejo, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/569,400

(22) Filed: May 12, 2000

(51) Int. Cl.[7] ..... G10L 19/08
(52) U.S. Cl. ..... 704/207; 704/219; 704/223
(58) Field of Search ..... 704/200, 207, 704/209, 219, 220, 216, 223, 224, 221

(56) References Cited

U.S. PATENT DOCUMENTS

| | | | | |
|---|---|---|---|---|
| 5,159,611 A | | 10/1992 | Tomita et al. | |
| 5,226,108 A | * | 7/1993 | Hardwick et al. | 704/200 |
| 5,495,555 A | * | 2/1996 | Swaminathan | 704/207 |
| 5,596,676 A | * | 1/1997 | Swaminathan et al. | 704/208 |
| 5,734,789 A | * | 3/1998 | Swaminathan et al. | 704/206 |
| 6,003,004 A | | 12/1999 | Hershkovits et al. | |
| 6,055,496 A | | 4/2000 | Heidari et al. | |
| 6,104,993 A | | 8/2000 | Ashley | |
| 6,141,638 A | | 10/2000 | Peng et al. | |

OTHER PUBLICATIONS

TIA/EIA Interim Standard Article: "Enhanced Variable Rate Codec, Speech Service Option 3 for Wideband Spread Spectrum Digital Systems," from Telecommunications Industry Association, No. TIA/EIA/IS–127, Jan. 1997, 6 pages (including cover page).

* cited by examiner

*Primary Examiner*—Daniel Abebe
(74) *Attorney, Agent, or Firm*—Farjami & Farjami LLP

(57) ABSTRACT

An encoding system is presented for coding and processing an input signal on a frame-by-frame basis. The encoding system processes each frame in two subframes of a first half and a second half. In determining the pitch of a given frame, the encoding system determines the pitch of the first half of the subsequent in a look-ahead fashion, and uses the look-ahead pitch information to estimate and correct the pitch of the second half subframe of the given frame. The encoding system also determines the pitch of the first half subframe of the given frame to further estimate and correct the pitch of the second half subframe of the given frame. The look-ahead pitch may also be used as the pitch of the first half subframe of the subsequent frame. The encoding system further calculates a normalized correlation using the pitch of the look-ahead subframe and may use the normalized correlation to correct and estimate the pitch of the second half subframe of the first frame.

10 Claims, 4 Drawing Sheets

LOOK-AHEAD PITCH DETERMINATION

BACKGROUND OF THE INVENTION

1. Field of the Invention

The present invention is generally in the field of signal coding. In particular, the present invention is in the field of pitch determination for speech coding.

2. Background Art

Traditionally, all parametric speech coding methods make use of the redundancy inherent in the speech signal to reduce the amount of information that must be sent and to estimate the value of speech samples of a signal at short intervals. This redundancy primarily arises from the repetition of wave shapes at a periodic rate.

The redundancy of speech wave forms may be considered with respect to several different types of speech signal, such as voiced and unvoiced. For voiced speech, the speech signal is essentially periodic; however, this periodicity may be variable over the duration of a speech segment and the shape of the periodic wave usually changes gradually from segment to segment. As for the unvoiced speech, the signal is more like a random noise and has a smaller amount of predictability.

In either case, parametric coding may be used to reduce the redundancy of the speech segments by separating the excitation component of the speech from the spectral envelop component. The coding advantage arises from the slow rate at which the parameters change. However, it is difficult to estimate exactly the rate at which the parameters change. Yet, it is rare for the parameters to be significantly different from the values held within a few milliseconds. Accordingly, the sampling rate of the speech is such that the nominal frame duration is in the range of five to thirty milliseconds. In a more recent ITU standard Evrc, G.723 or EFR that has adopted the Code Excited Linear Prediction Technique ("CELP"), each frame includes 160 samples and is 20 milliseconds long.

A robust estimation of the pitch or fundamental frequency of speech is one of the classic problems in the art of speech coding. Accurate pitch estimation is a key to any speech coding algorithm. In CELP, for example, the pitch estimation is performed for each frame. For pitch estimation purposes, each 20 ms frame is processed in two 10 ms subframes. First, the pitch lag of the first 10 ms subframe is estimated using an open loop pitch estimation method. Subsequently, the pitch lag of the second 10 ms is estimated in a similar fashion. However, at the time of estimating the pitch lag of the second subframe, additional information or the pitch lag information of the first subframe is available to more accurately estimate the pitch lag of the second subframe. Traditionally, such information is used to better estimate and correct the pitch lag of the second subframe. The traditional approach allows for the past pitch information to be used for estimating the future pitch lag, since, as stated above, speech parameters are not significantly different from the values held within a few milliseconds previously. In particular, the pitch changes very slowly during voiced speech.

Referring to FIG. 2, an application of a conventional pitch lag estimation method is illustrated with reference to a speech signal 220. As shown, frame1 212 is shown in two subframes for which pitch lag0 231 and pitch lag1 232 are estimated. The pitch lag0 231 is obtained before the pitch lag1 232 and is available for correcting the pitch lag1 232. As further shown, the pitch lag information for each subframe of subsequent frames 213, 214, . . . 216 are computed in a sequential fashion. For example, the pitch lag1 232 information would be available to help estimate pitch lag0 of frame2 213, pitch lag0 233 would be available to help estimate pitch lag1 234, and so on. Accordingly, the past pitch information is conventionally used to estimate subsequent pitch lags.

The conventional approach suffers from incorrectly assuming that the past pitch lag information is always a proper indication of what follows. The conventional approach also lacks the ability to properly estimate the pitch in speech transition areas as well as other areas. Accordingly, there is a serious need in the art to provide a more accurate pitch estimation, especially in speech transition areas from unvoiced to voiced speech.

SUMMARY OF THE INVENTION

In accordance with the purpose of the present invention as broadly described herein, there is provided method and system for speech coding.

The encoder of the present invention processes an input signal on a frame-by-frame basis. Each frame is divided into first half and second half subframes. For a first frame, a pitch of the first half subframe of a subsequent frame (look-ahead subframe) is estimated. Using the look-ahead pitch information, a pitch of the second half subframe of the first frame is estimated and corrected.

In one aspect of the present invention, a pitch of the first half subframe of the first frame is also estimated and used to better estimate and correct the pitch of the second half subframe of the first frame. In another aspect of the invention, the pitch of the look-ahead frame is used as the pitch of the first half subframe of the subsequent frame.

In yet another aspect of the invention, a normalized correlation is calculated using the pitch of the look-ahead subframe. The normalized correlation is used to correct and estimate the pitch of the second half subframe of the first frame.

Other aspects of the present invention will become apparent with further reference to the drawings and specification, which follow.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The present invention discloses an improved pitch determination system and method. The following description contains specific information pertaining to the Extended Code Excited Linear Prediction Technique ("eX-CELP").

However, one skilled in the art will recognize that the present invention may be practiced in conjunction with various speech coding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

Figure 1:
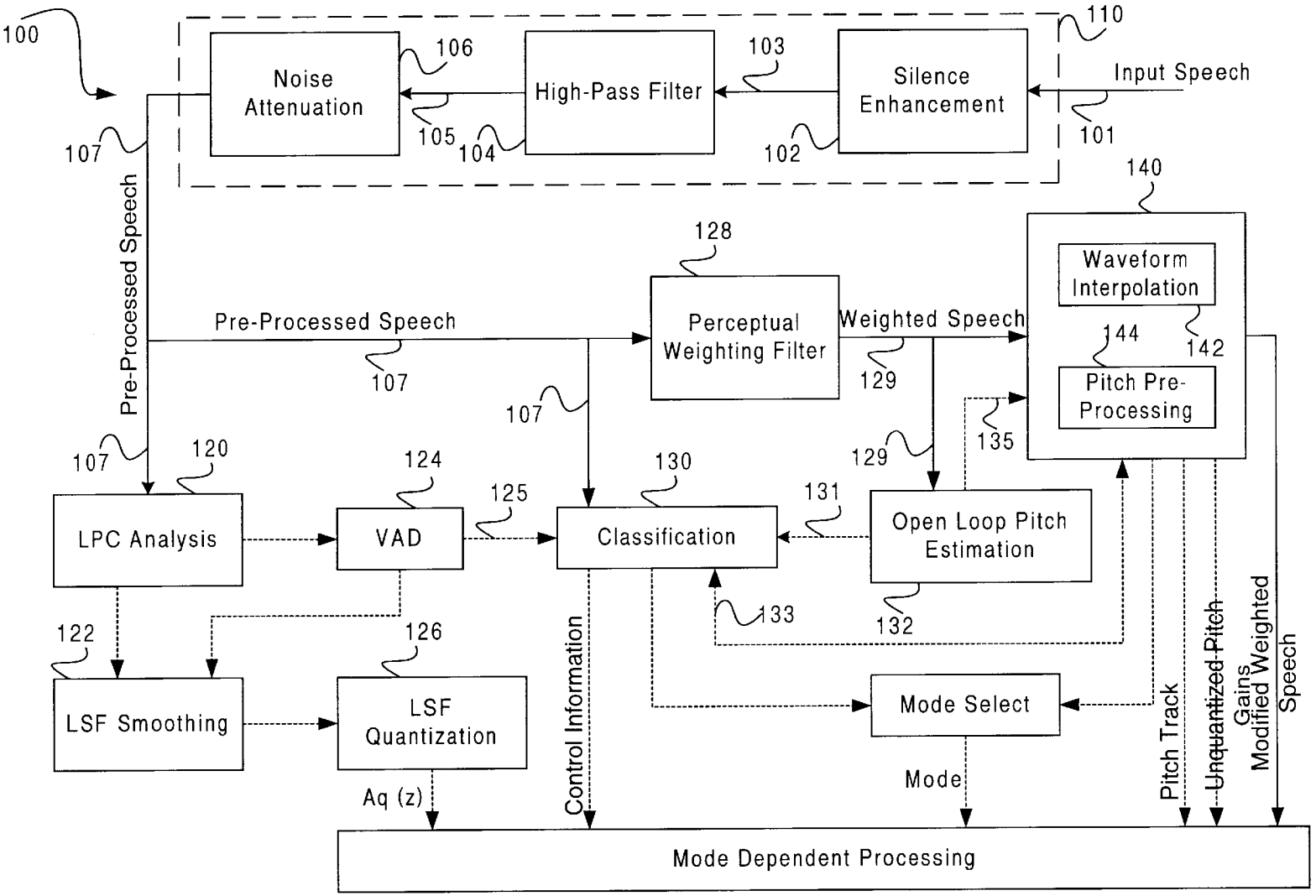
FIG. 1 illustrates an encoding system according to one embodiment of the present invention.
Figure 2:
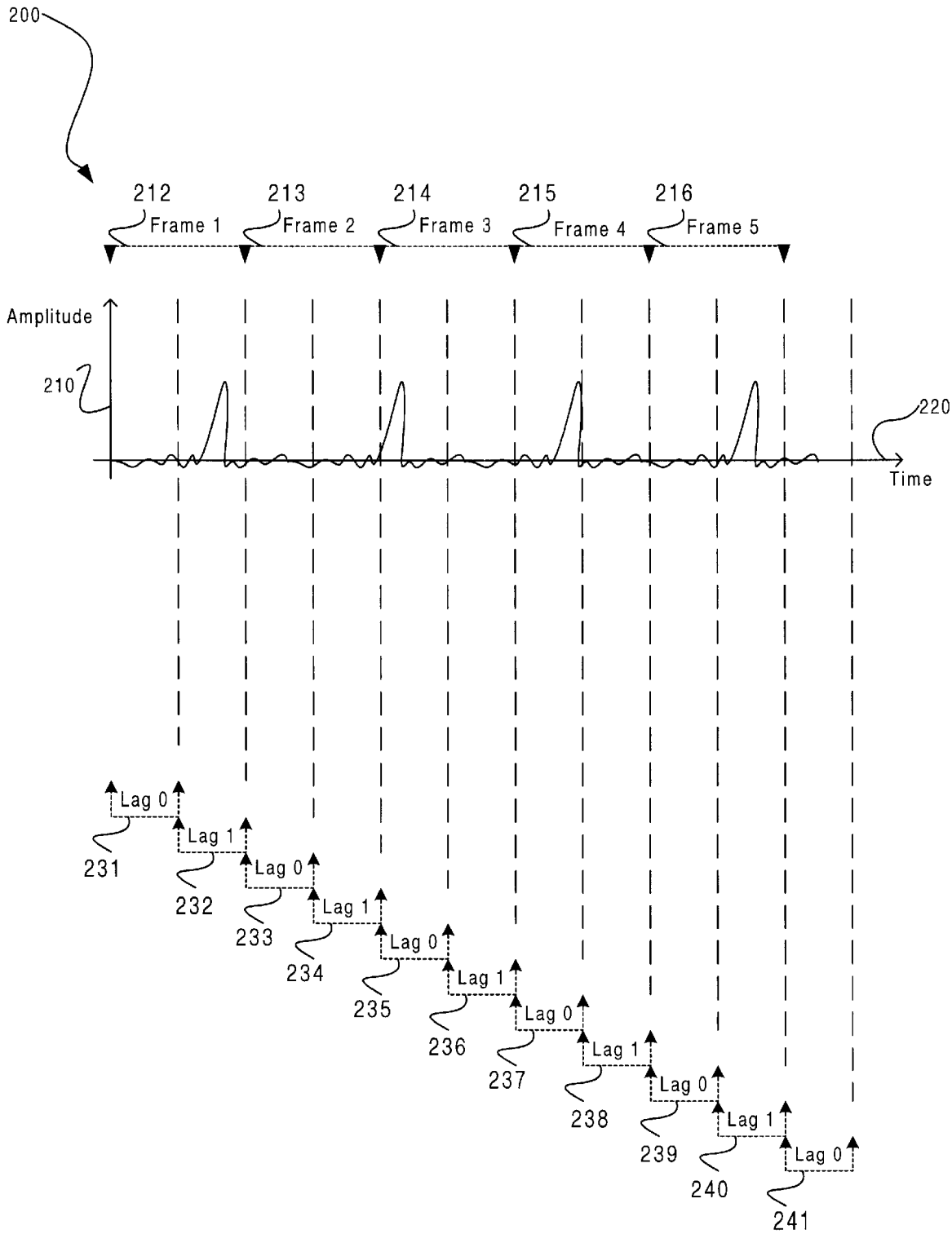
Figure 2 (Prior Art)
FIG. 2 illustrates an example application of a conventional pitch determination algorithm.

FIG. 1 illustrates a block diagram of an example encoder 100 capable of embodying the present invention. With reference to FIG. 1, the frame based processing functions of the encoder 100 are explained. As shown, an input speech signal 101 enters a speech preprocessor block 110. After reading and buffering samples of the input speech 101 for a given speech frame, the input speech signal 101 samples are analyzed by a silence enhancement module 102 to determine whether that speech frame is pure silence, in other words, whether only silence noise is present.

The silence enhancement module 102 adaptively tracks the minimum resolution and levels of the signal around zero. According to such tracking information, the silence enhancement module 102 adaptively detects, on a frame-by-frame, basis whether the current frame is silence and whether the component is purely silence-noise. If the silence enhancement module 102 detects silence noise, the silence enhancement module 102 ramps the input speech signal 101 to the zero-level of the input speech signal 101. Otherwise, the input speech signal 101 is not modified. It should be noted that the zero-level of the input speech signal 101 may depend on the processing prior to reaching the encoder 100. In general, the silence enhancement module 102 modifies the signal if the sample values for a given frame are within two quantization levels of the zero-level.

In short, the silence enhancement module 102 cleans up the silence parts of the input speech signal 101 for very low noise levels and, therefore, enhances the perceptual quality of the input speech signal 101. The effect of the silence enhancement module 102 becomes especially noticeable when the input signal 101 originates from an A-law source or, in other words, the input signal 101 has passed through A-law encoding and decoding immediately prior to reaching the encoder 100.

Turning to FIG. 1, at this stage, the silence enhanced input speech signal 103 is then passed through a high-pass filter module 104 of a $2^{nd}$ order pole-zero with a cut-off frequency of 140 Hz. The silence enhanced input speech signal 103 is scaled down by a factor of two by the high-pass filter module 104 that is defined by the following transfer function.

$$H(z) = \frac{0.92727435 - 1.8544941\,z^{-1} + 0.92727435\,z^{-2}}{1 - 1.9059465\,z^{-1} + 0.9114024\,z^{-2}}$$

The high-pass filtered speech signal 105 is then routed to a noise attenuation module 106. At this point, the noise attenuation module 106 performs a weak noise attenuation of the environmental noise in order to improve the estimation of the parameters, and still leave the listener with a clear sensation of the environment.

As shown in FIG. 1, the pre-processing phase of the speech signal 101 is followed by an encoding phase, as the pre-processed speech signal 107 emerges from the speech preprocessor block 110. At the encoding phase, the encoder 100 processes and codes the pre-processed speech signal 107 at 20 ms intervals. At this stage, for each speech frame several parameters are extracted from the pre-processed speech signal 107. Some parameters, such as spectrum and initial pitch estimate parameters may later be used in the coding scheme. However, other parameters, such as maximal sample in a frame, zero crossing rates, LPC gain or signal sharpness parameters may only be used for classification and rate determination purposes.

As further shown in FIG. 1, the pre-processed speech signal 107 enters a linear predictive coding ("LPC") analysis module 120. A linear predictor is used to estimate the value of the next sample of a signal, based upon a linear combination of the most recent sample values. At the LPC analysis module 120, a $10^{th}$ order LPC analysis is performed three times for each frame using three different-shape windows. The LPC analyses are centered and performed at the middle third, the last third and the look-ahead of each speech frame. The LPC analysis for the look-ahead is recycled for the next frame as the LPC analysis is centered at the first third of each frame. Accordingly, for each speech frame, four sets of LPC parameters are available.

A symmetric Hamming window is used for the LPC analyses of the middle and last third of the frame, and an asymmetric Hamming window is used for the LPC analysis of the look-ahead in order to center the weight appropriately.

For each of the windowed segments the $10^{th}$ order, auto-correlation is calculated according to $$r(k) = \sum_{n=k}^{N-1} s_w(n) \cdot s_w(n-k),$$

where $s_w(n)$ is the speech signal after weighting with the proper Hamming window.

Bandwidth expansion of 60 Hz and a white noise correction factor of 1.0001, i.e. adding a noise floor of −40 dB, are applied by weighting the auto-correlation coefficients according to $r_w(k)=w(k)\cdot r(k)$, where the weigthing function is given by $$w(k) = \begin{cases} 1.0001 & k = 0 \\ \exp\left[-\frac{1}{2}\left(\frac{2\pi \cdot 60 \cdot k}{8000}\right)\right] & k = 1, 2, \ldots, 10. \end{cases}$$

Based on the weighted auto-correlation coefficients, the short-term LP filter coefficients, i.e.

$$A(z) = 1 - \sum_{i=1}^{10} a_i \cdot z^{-i},$$

are estimated using the Leroux-Gueguen algorithm, and the line spectrum frequency ("LSF") parameters are derived from the polynomial A(z). The three sets of LSFs are denoted $\mathbf{1}sf_1(k)$, k=1,2 . . . ,10, where $\mathbf{1}sf_2(k)$, $\mathbf{1}sf_3(k)$, and $\mathbf{1}sf_4$ (k) are the LSFs for the middle third, last third and lookahead of each frame, respectively.

Next, at the LSF smoothing module 122, the LSFs are smoothed to reduce unwanted fluctuations in the spectral envelope of the LPC synthesis filter (not shown) in the LPC analysis module 120. The smoothing process is controlled by the information received from the voice activity detection ("VAD") module 124 and the evolution of the spectral envelope. The VAD module 124 performs the voice activity detection algorithm for the encoder 100 in order to gather information on the characteristics of the input speech signal 101. In fact, the information gathered by the VAD module 124 is used to control several functions of the encoder 100, such as estimation of signal to noise ratio ("SNR"), pitch estimation, classification, spectral smoothing, energy smoothing and gain normalization. Further, the voice activity detection algorithm of the VAD module 124 may be based on parameters such as the absolute maximum of frame, reflection coefficients, prediction error, LSF vector, the $10^{th}$ order auto-correlation, recent pitch lags and recent pitch gains.

Turning to FIG. 1, an LSF quantization module 126 is responsible for quantizing the $10^{th}$ order LPC model given by the smoothed LSFs, described above, in the LSF domain. A three-stage switched MA predictive vector quantization scheme may be used to quantize the ten (10) dimensional LSF vector. The input LSF vector (unquantized vector) originates from the LPC analysis centered at the last third of the frame. The error criterion of the quantization is a WMSE (Weighted Mean Squared Error) measure, where the weighting is a function of the LPC magnitude spectrum. The objective of the quantization is set forth as $$\{\hat{lsf}_n(1), \hat{lsf}_n(1), \ldots, \hat{lsf}_n(10)\} = \text{argmin}\left\{\sum_{k=1}^{10} w_i \cdot (lsf_n(k) - \hat{lsf}_n(k))^2\right\},$$

where the weighting is $w_i=|P(1sf_n(i)|^{0.4}$, where $|P(f)|$ is the LPC power spectrum at frequency f, the index n denotes the frame number. The quantized LSFs $1\hat{s}f_n(k)$ of the current frame are based on a $4^{th}$ order MA predcition and is given by $1\hat{s}f_n=1\tilde{s}f_n+\hat{\Delta}_n^{1sf}$, where $1\tilde{s}f$ is the predicted LSFs of the current frame (a function of $\{\hat{\Delta}_{n-1}^{1sf},\hat{\Delta}_{n-2}^{1sf},\hat{\Delta}_{n-3}^{1sf},\hat{\Delta}_{n-4}^{1sf}\}$), and $\hat{\Delta}_n^{1sf}$ is the quantized prediction error at the current frame. The prediction error is given by $\Delta_n^{1sf}=1sf_n-1\tilde{s}f_n$. In one embodiment, the prediction error from the $4^{th}$ order MA prediction is quantized with three ten (10) dimensional codebooks of sizes 7 bits, 7 bits, and 6 bits, respectively. The remaining bit is used to specify either of two sets of predictor coefficients, where the weaker predictor improves or reduces error propagation during channel errors. The prediction matrix is fully populated. In other words, prediction in both time and frequency is applied. Closed loop delayed decision is used to select the predictor and the final entry from each stage based on a subset of candidates. The number of candidates from each stage is ten (10), resulting in the future consideration of 10, 10 and 1 candidates after the $1^{st}$, $2^{nd}$, and $3^{rd}$ codebook, respectively.

After reconstruction of the quantized LSF vector as described above, the ordering property is checked. If two or more pairs are flipped, the LSF vector is declared erased, and instead, the LSF vector is reconstructed using the frame erasure concealment of the decoder. This facilitates the addition of an error check at the decoder, based on the LSF ordering while maintaining bit-exactness between encoder and decoder during error free conditions. This encoder-decoder synchronized LSF erasure concealment improves performance during error conditions while not degrading performance in error free conditions. Moreover, a minimum spacing of 50 Hz between adjacent LSF coefficients is enforced.

As shown in FIG. 1, the pre-processed speech 107 further passes through a perceptual weighting filter module 128. According to one embodiment of the present invention, the perceptual weighting filter module 128 includes a pole zero filter and an adaptive low pass filter. The traditional pole-zero filter is derived from the unquantized LPC filter given by $$W_1(z) = \frac{A(z/\gamma_1)}{A(z/\gamma_2)},$$

where $\gamma_1=0.9$ and $\gamma_2=0.55$. The pole-zero filter is primarily used for the adaptive and fixed codebook searches and gain quantization.

The adaptive low-pass filter of the module 128, however, is given by $$W_2(z) = \frac{1}{1-\eta z^{-1}},$$

where $\eta$ is a function of the tilt of the spectrum or the first reflection coefficient of the LPC analysis. The adaptive low-pass filter is primarily used for the open loop pitch estimation, the waveform interpolation and the pitch pre-processing.

Referring to FIG. 1, the encoder 100 further classifies the pre-proceesed speech signal 107. The calssification module 130 is used to emphasize the perceptually important features during encoding. According to one embodiment, the three main frame-based classifications are detection of unvoiced noise-like speech, a six-grade signal characteristic classification, and a six-grade classification to control the pitch pre-processing. The detection of unvoiced noise-like speech is primarily used for generating a pitch pre-processing. In one embodiment, the classification module 130 classifies each frame into one of six classes according to the dominating feature of that frame. The classes are: (1) Silence/Background Noise, (2) Noise-Like Unvoiced Speech, (3) Unvoiced, (4) Onset, (5) Non-Stationary Voiced and (6) Stationary Voiced. In some embodiments, the classification module 130 does not initially distinguish between non-stationary and stationary voiced of classes 5 and 6, and instead, this distinction is performed during the pitch pre-processing, where additional information is available to the encoder 100. As shown, the input parameters to the classification module 130 are the pre-processed speech signal 107, a pitch lag 131, a correlation 133 of the second half of each frame and the VAD information 125.

Turning to FIG. 1, it is shown that the pitch lag 131 is estimated by an open loop pitch estimation module 132. For each 20 ms frame, the open loop pitch lag has to be estimated for the first half and the second half of the frame. These estimations may be used for searching an adaptive codebook or for an interpolated pitch track for the pitch pre-processing. The open loop pitch estimation is based on the weighted speech given by $S_w(z)=S(z)\cdot W_1(z)W_2(z)$, where S(z) is the pre-processed speech signal 107. Two sets of open loop pitch lags and pitch correlation coefficients are estimated per frame. The first set is centered at the second half of the frame and the second set is centered at the first half frame of the subsequent frame, i.e. the look-ahead frame. The set centered at the look-ahead portion is recycled for the subsequent frame and used as a set centered at the first half of the frame. Accordingly, for each frame, there are three sets of pitch lags and pitch correlation coefficients available to the encoder 100 at the computational expense of only two sets, i.e., the sets centered at the second half of the frame and at the look-ahead. Each of these two sets is calculated according to the following normalized correlation function:

$$R(k) = \frac{\sum_{n=0}^{L} s_w(n) \cdot s_w(n-k)}{E},$$

where L=80 is the window size, and $$E = \sum_{n=0}^{L} s_w(n)^2$$

is the energy of the segment. The maximum of the normalized correlation R(k) in each of three regions [17,33], [34,67], and [68,127] are determined, which determination results in three candidates for the pitch lag. An initial best candidate from the three candidates is selected based on the normalized correlation, classification information and the history of the pitch lag.

Once the initial best lags for the second half of the frame and the lookahead are available, the initial lags at the first half, the second half and the lookahead of the frame may be estimated. A final adjustment of the estimates of the lags for the first and second half of the frame may be performed based on the context of the respective lags with regards to the overall pitch contour. For example, for the pitch lag of the second half of the frame, information on the pitch lag in the past (first half) and the future (look-ahead) is available.

Figure 3:
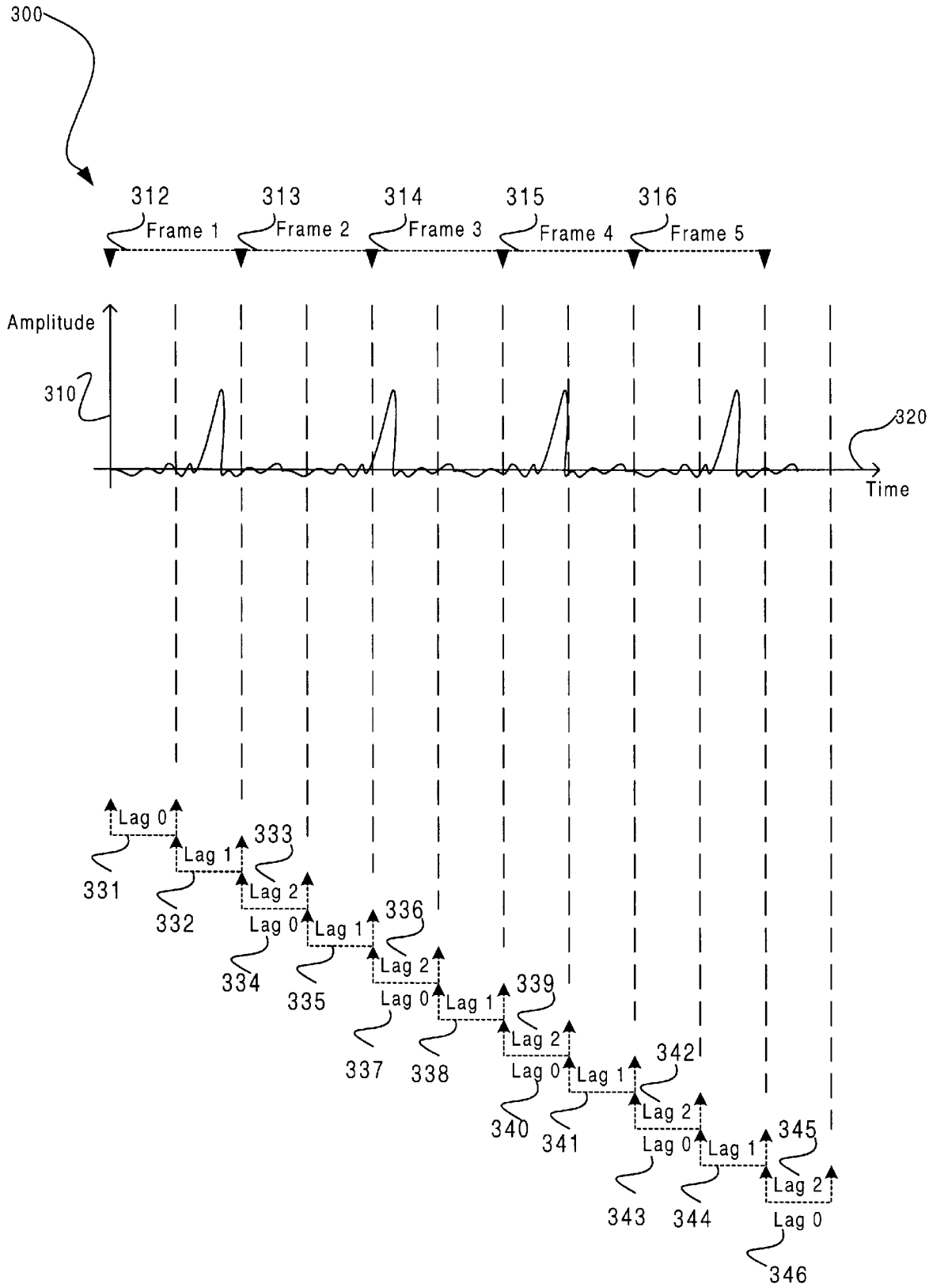
FIG. 3 illustrates an example application of a pitch determination algorithm according to one embodiment of the present invention.

Turning to FIG. 3, an example input speech signal 320 is shown. In the embodiment shown, two consecutive lags, for example lag0 331 and lag1 332 form a 20 ms frame1 312 which consists of two 10 ms subframes. Typically, each subframe consists of 80 samples. FIG. 3 also shows look-ahead lags, e.g., lag2 333, 336, 339, . . . 345. The look-ahead lag2 333 is a 10 ms subframe of a frame following frame1 312, i.e., frame2 313. As shown, the look-ahead frame or lag2 33 is also a first subframe of the frame2 313, i.e., lag0 334.

In order to obtain a more stable and more accurate pitch lag information, the encoder 100 performs two pitch lag estimations for each frame. With reference to the frame2 313 of FIG. 3, it is shown that lag1 335 and lag2 336 are estimated for frame2 313. Similarly, lag1 338 and lag2 339 are estimated for frame3 314, and so on. Unlike the conventional method of pitch estimation that uses lag0 and lag1 information for pitch estimation of each frame, this embodiment of the present invention uses lag1 and the look-ahead subframe, i.e., lag2. As a result, the encoder 100 complexity remains the same, yet the pitch estimation capability of the encoder 100 is substantially improved. The complexity remains the same, because the encoder 100 still performs two pitch estimations, i.e., lag1 and lag2, for each frame. The pitch estimation capability, on the other hand, is substantially improved as a result of having access to future lag2 or the look-ahead pitch information. The look-ahead pitch information provides a better estimation for lag1. Accordingly, lag1 may be better estimated and corrected which will result in a smoother signal. Further, the look-ahead signal is available from estimation of the LPC parameters, as described above.

Referring to frame3 314 of FIG. 3, it is shown that lag1 338 falls in between lag2 336 of the frame2 313 and lag2 339 of the frame4 315. Lag2 336 of the frame2 313 is in fact the first subframe of the frame3 314 or lag0 337. In one embodiment, the lag2 336 information is retained in memory and also used as lag0 337 in estimating lag1 338. Accordingly, there are in fact three estimations available at one time, lag0, lag1 and lag2. Because lag1 falls in between lag0 and lag2, by definition, lag1 closer in time to lag0 and lag2 estimations. It has been determined that the closer the signals together in time, the more accurate are their estimation and correllation.

Figure 4:
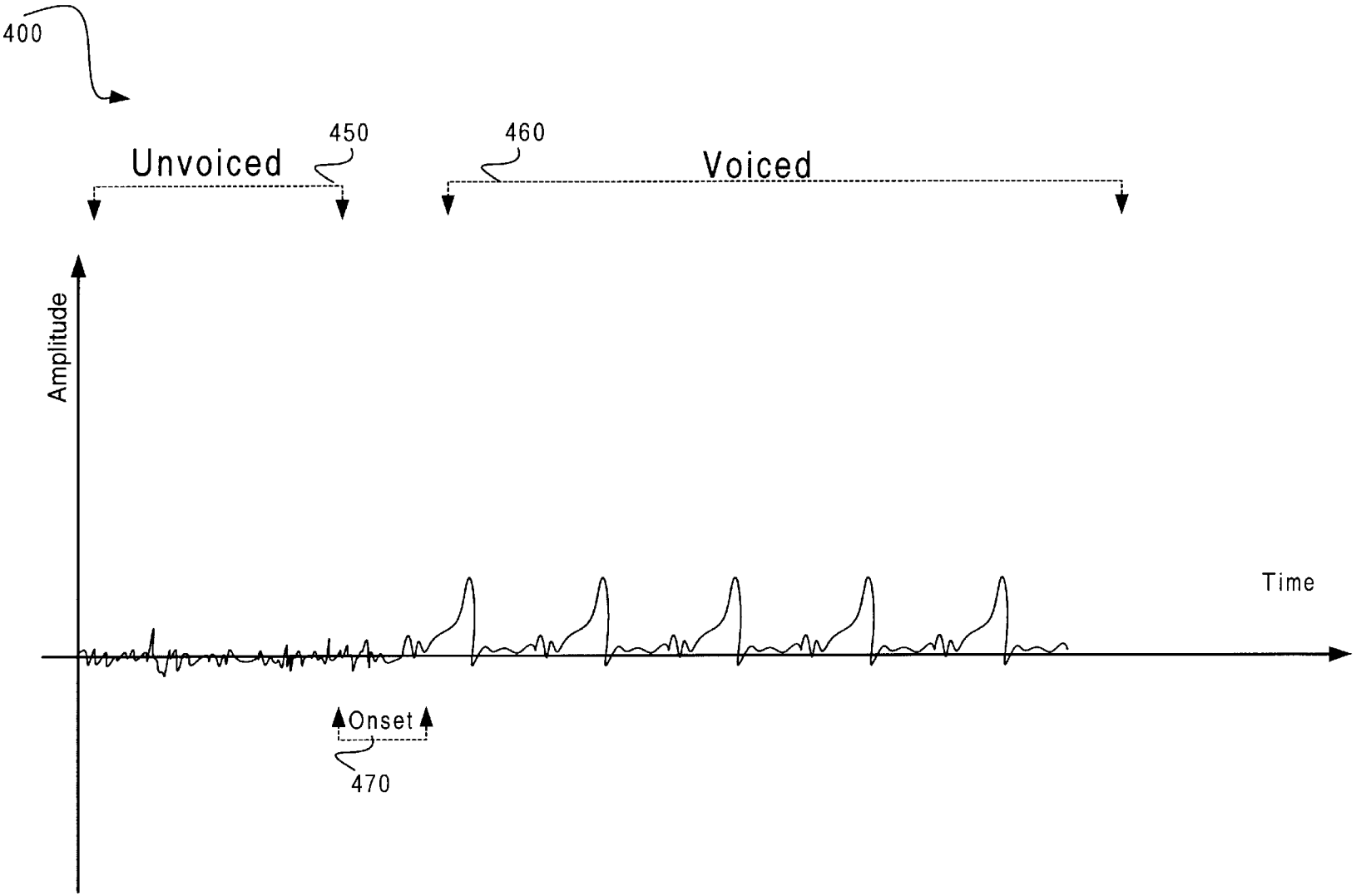
FIG. 4 illustrates an example transition from unvoiced to voiced speech.

Furthermore, use of the look-ahead signal or pitch lag2 is particularly beneficial in onset areas of speech. Onset occurs at the transition of an irregular signal to a regular signal. With reference to FIG. 4, the onset 470 is the transition of speech from unvoiced 450 (irregular speech) to voiced 460 (regular speech). As explained above, the normalized correlation R(k) of each pitch signal lag0, lag1 and lag2 may be calculated as Rp0, Rp1 and Rp2, rspectively. In the onset area 470, Rp2 may be considerably larger than Rp1. In one embodiment, in addition to considering the lag pitch estimation, the correlation information is also considered. For example, if Rp0 is smaller than Rp1 but Rp2 is much larger, lag1 estimation is probably inaccurate. Accordingly, another advantage of the present invention is to provide Rp2 in addition to Rp0 and Rp1 for a more accurate pitch estimation at no adddional cost or system complexity.

Turning back to FIG. 1, it is shown that weighted speech 129 from the perceptual weighting filter module 128 and pitch estimation information 135 from the open loop pitch estimation module enter an interpolation-pitch module 140. The module 140 includes a waveform interpolation module 142 and a pitch pre-processing module 144.

The interpolation-pitch module 140 performs various functions. For one, the interpolation-pitch module 140 modifies the speech signal 101 to obtain a better match the estimated pitch track and accurately fit a coding model while being perceptually indistinguishable. Further, the interpolation-pitch module 140 modifies certain irregular transition segments to fit the coding model. Such modification enhances the regularity and suppresses the irregularity using forward-backward waveform interpolation. The modification, however, is performed without loss of perceptual quality. In addition, the interpolation-pitch module 140 estimates the pitch gain and pitch correlation for the modified signal. Lastly, the interpolation-pitch module 140 refines the signal characteristic classification based on the additional signal information obtained during the analysis for the waveform interpolation and pitch pre-processing.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A method of pitch determination for a speech signal, said speech signal having a plurality of frames, each of said plurality of frames having a first subframe and a second subframe, said plurality of frames including a present frame, a previous frame, and a subsequent frame, wherein said present frame is between said previous frame and said subsequent frame, wherein a first subframe of said present frame is a look-ahead subframe of said previous frame, and wherein a first subframe of said subsequent frame is a look-ahead subframe of said present frame, said method comprising the steps of:

calculating a look-ahead pitch of said look-ahead subframe of said present frame;

storing said look-ahead pitch of said look-ahead subframe of said present frame to be retrieved for calculating a pitch of a second subframe of said subsequent frame;

retrieving a look-ahead pitch of said look-ahead subframe of said previous frame; and using said look-ahead pitch of said look-ahead subframe of said previous frame and said look-ahead pitch of said look-ahead subframe of said present frame to determine a pitch of said second subframe of said present frame;

wherein said steps of calculating, storing, retrieving and using are repeated for each of said plurality of frames.

2. The method of claim 1 further comprising the steps of:

calculating a normalized pitch correlation of said look-ahead subframe of said present frame; and storing said normalized pitch correlation to be retrieved for calculating said pitch of said second subframe of said subsequent frame.

3. The method of claim 2 further comprising the steps of:

retrieving a normalized pitch correlation of said look-ahead subframe of said previous frame; and using said normalized pitch correlation of said look-ahead subframe of said previous frame and said normalized pitch correlation of said look-ahead subframe of said present frame to determine said pitch of said second subframe of said present frame.

4. The method of claim 1, wherein each of said plurality of subframes is about 10 milliseconds.

5. The method of claim 1, wherein said using determines said pitch of said second subframe of said present frame based on an overall pitch contour.

6. A speech coding system for encoding a speech signal, said speech signal having a plurality of frames, each of said plurality of frames having a first subframe and a second subframe, said plurality of frames including a present frame, a previous frame, and a subsequent frame, wherein said present frame is between said previous frame and said subsequent frame, wherein a first subframe of said present frame is a look-ahead subframe of said previous frame, and wherein a first subframe of said subsequent frame is a look-ahead subframe of said present frame, said system comprising:

a pitch estimator configured to calculate a look-ahead pitch of said look-ahead subframe of said present frame; and a memory configured to store said look-ahead pitch of said look-ahead subframe of said present frame to be retrieved for calculating a pitch of a second subframe of said subsequent frame, said memory retaining a look-ahead pitch of said look-ahead subframe of said previous frame;

wherein said pitch estimator uses said look-ahead pitch of said look-ahead subframe of said previous frame and said look-ahead pitch of said look-ahead subframe of said present frame to determine a pitch of said second subframe of said present frame;

wherein said pitch estimator determines a pitch of said second subframe of each of said plurality of frames in the same manner as determining said pitch of said second subframe of said present frame.

7. The system of claim 6, wherein said pitch estimator is further configured to calculate a normalized pitch correlation of said look-ahead subframe of said present frame, and said memory is further configured to store said normalized pitch correlation to be retrieved for calculating said pitch of said second subframe of said subsequent frame.

8. The system of claim 7, wherein said pitch estimator is further configured to retrieve a normalized pitch correlation of said look-ahead subframe of said previous frame from said memory, and to use said normalized pitch correlation of said look-ahead subframe of said previous frame and said normalized pitch correlation of said look-ahead subframe of said present frame to determine said pitch of said second subframe of said present frame.

9. The system of claim 6, wherein each of said plurality of subframes is about 10 milliseconds.

10. The method of claim 6, wherein said pitch estimator determines said pitch of said second subframe of said present frame based on an overall pitch contour.

* * * * *